US008262977B2

(12) United States Patent
Schlusselbauer

(10) Patent No.: US 8,262,977 B2
(45) Date of Patent: Sep. 11, 2012

(54) PROCESS FOR THE MANUFACTURE OF A SHAFT BOTTOM

(76) Inventor: Johann Schlusselbauer, Altenhof (AT)

( * ) Notice: Subject to any disclaimer, the term of this patent is extended or adjusted under 35 U.S.C. 154(b) by 386 days.

(21) Appl. No.: 11/241,969

(22) Filed: Oct. 4, 2005

(65) Prior Publication Data

US 2006/0087056 A1 Apr. 27, 2006

Related U.S. Application Data

(63) Continuation of application No. PCT/AT2004/000110, filed on Mar. 26, 2004.

(30) Foreign Application Priority Data

Apr. 15, 2003 (DE) ..... 103 17 321
Apr. 29, 2003 (AT) ..... A 653/2003

(51) Int. Cl.

| | |
|---|---|
| ***B28B 1/14*** | (2006.01) |
| ***B28B 21/04*** | (2006.01) |
| *B28B 7/16* | (2006.01) |
| *B28B 7/18* | (2006.01) |
| *B28B 7/30* | (2006.01) |
| *B28B 7/34* | (2006.01) |

(52) U.S. Cl. ..... 264/333

(58) Field of Classification Search ..... 264/333
See application file for complete search history.

(56) References Cited

U.S. PATENT DOCUMENTS

| | | | | |
|---|---|---|---|---|
| 3,363,876 | A * | 1/1968 | Moore | 249/145 |
| 4,177,229 | A | 12/1979 | Moore | |
| 4,427,619 | A | 1/1984 | Peterson | |
| 4,591,470 | A * | 5/1986 | Goto et al. | 264/635 |
| 4,650,149 | A * | 3/1987 | Poulette et al. | 249/11 |
| 4,867,411 | A | 9/1989 | Dorsey et al. | |

FOREIGN PATENT DOCUMENTS

| | | |
|---|---|---|
| AT | 0 01 821 U1 | 11/1997 |
| DE | 36 11 394 | 10/1987 |
| DE | 43 42 518 | 6/1995 |
| DE | 199 12 829 A1 | 10/1999 |
| DE | 298 10 679 U1 | 10/1999 |
| FR | 2 498 657 | 7/1982 |
| JP | 2-147302 | 6/1990 |
| JP | 7-42185 | 2/1995 |
| WO | WO 98/23820 A1 | 6/1998 |

* cited by examiner

*Primary Examiner* — Christina Johnson
*Assistant Examiner* — Patrick Butler
(74) *Attorney, Agent, or Firm* — Dickstein Shapiro LLP

(57) ABSTRACT

The invention relates to a method for producing a concrete shaft bottom which comprises a drain having a defined shape. According to said method, concrete is introduced into a bottom mold (1) that comprises a mold jacket (2) and a mold bottom (3). On said mold bottom (3), a molded body (8) forming the negative shape of the drain is disposed to configure the drain. The aim of the invention is to allow for the inexpensive and mechanized production of a shaft bottom having an individual drain. For this purpose, the molded body (8) is configured from at least one molded piece (9) that is fixed on the bottom mold (1), especially on the mold bottom (3). The molded piece (9) is adapted to the dimensions of the defined shape of the drain and is removed from the shaft bottom once or while the formwork is dismantled from the shaft bottom.

14 Claims, 7 Drawing Sheets

Figure 3:
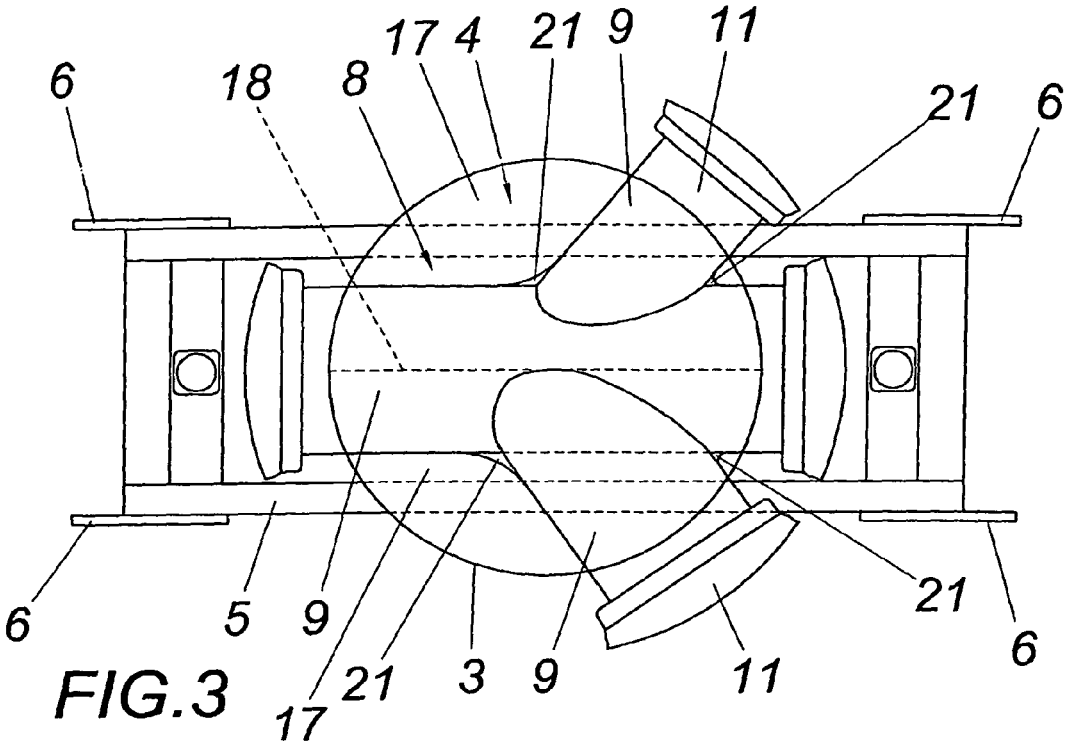

FIG.1
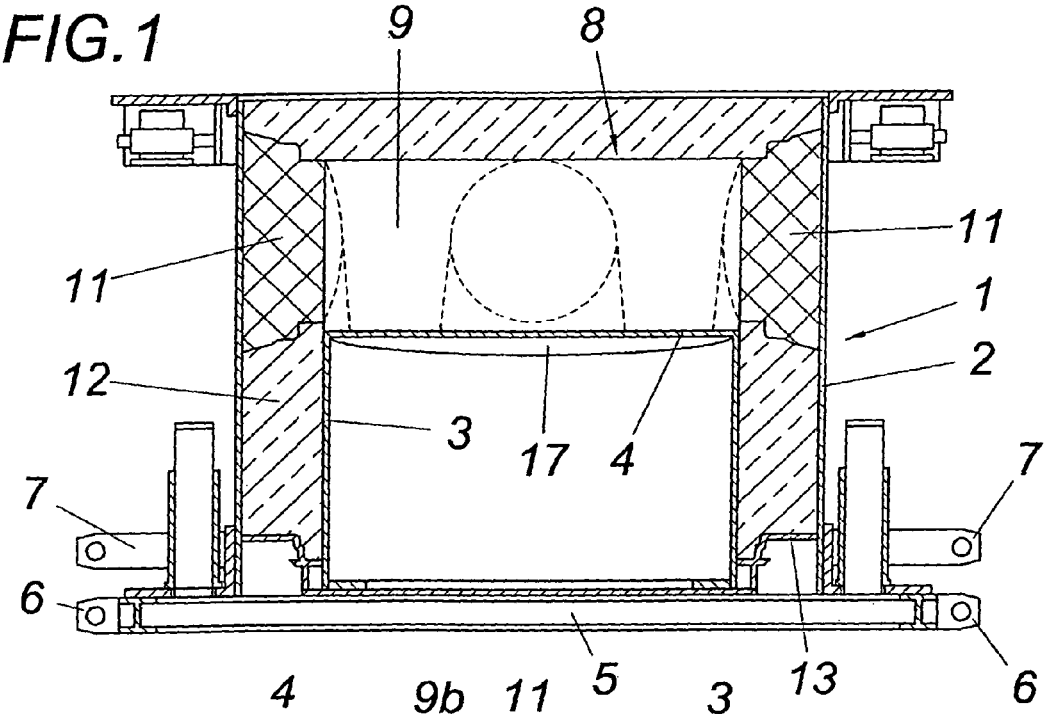
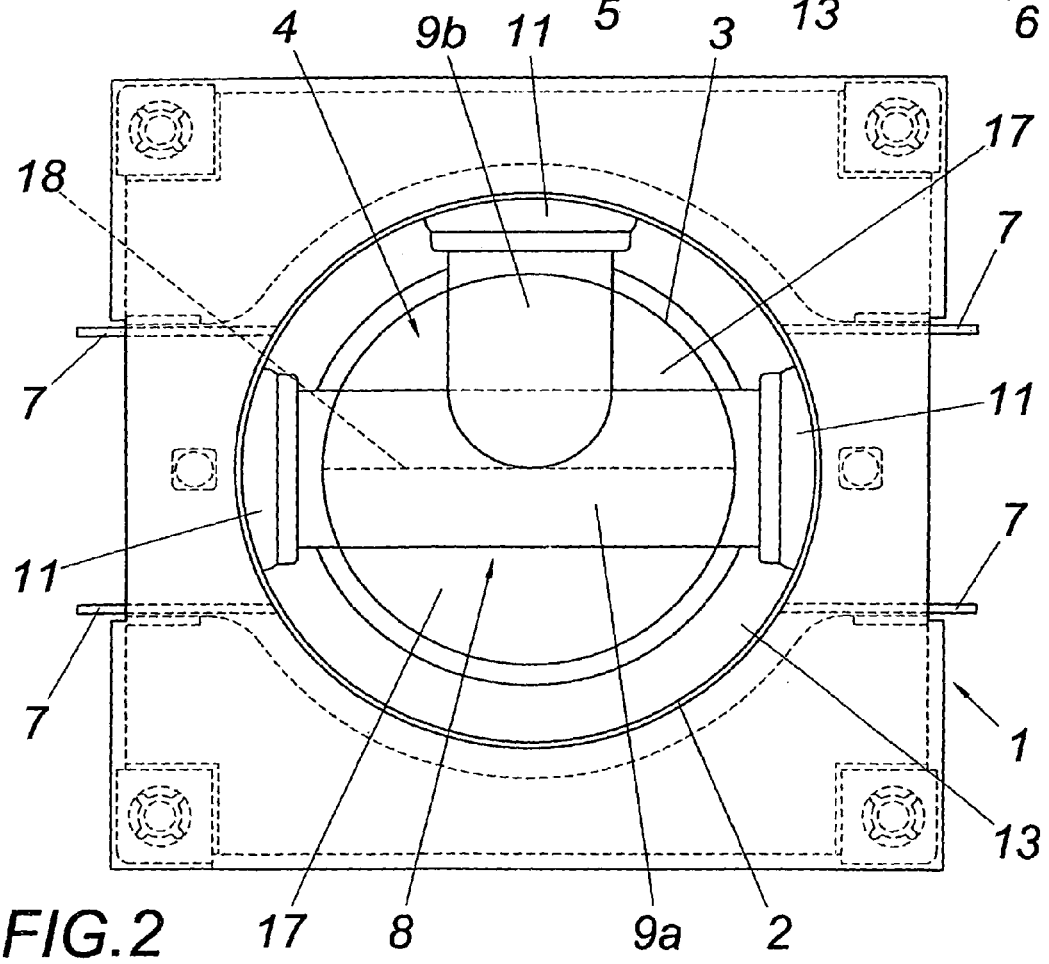
FIG.2

PROCESS FOR THE MANUFACTURE OF A SHAFT BOTTOM

This is a continuation of International Application No. PCT/AT2004/000110, filed Mar. 26, 2004.

The invention relates to a process for the manufacture of a shaft bottom made of concrete and comprising a chute of a predetermined shape, wherein concrete is introduced into a bottom mould comprising a mantle and a mould bottom, on which mould bottom a moulded body forming the negative mould of the chute is arranged for the formation of the chute, with the moulded body being formed from at least one moulded piece which can be fastened to the bottom mould, in particular to the mould bottom, which moulded piece is adjusted to the dimensions of the predetermined shape of the chute and is removed from the shaft bottom after or simultaneously with stripping the formwork from the shaft bottom, as well as to a device for the manufacture of such a shaft bottom, a moulded body therefor and a moulded piece for the manufacture of the moulded body.

Shaft bottoms form the lower impervious closure of normally vertical shafts which permit sewage systems to have access to canals such as sewers and underground pipeline systems. Such shafts are often located at intersecting points of canals or pipeline systems, respectively, i.e. at canal branchings or outlets and inlets, respectively, of subsidiary canals etc. The shaft bottoms forming the lower closure of such shafts are pot-shaped formations having a comparatively thick-walled impervious bottom and a mostly cylindrical side wall in which connection ports for the pipes and/or canals are formed. Canals open at the top and usually having a semicircular or roughly U-shaped cross-section, which are referred to as chutes, run in the shaft bottom between the respective connection ports provided in the side wall of a shaft bottom. In order to guarantee a congestion-free flow of the fluids which often are contaminated by substantial amounts of lumpy solids, the chutes have a certain gradient and the shaft bottom has a tread with a small inclination, also referred to as a berm.

Although the shafts are composed of standardized individual rings, the shaft bottoms are uniquely shaped components which differ in terms of the positioning of the connection ports functioning as inflows and outflows, the cross-sectional shape of the chutes and the pipes to be connected thereto. Moreover, only high-quality fluid-tight concrete may be used for the manufacture of lower shaft parts and in particular of the chutes thereof.

From DE 36 11 394 A1 it is known for the production of a shaft bottom to arrange a mould bottom, the top side of which is shaped according to the negative mould of the chute, in a bottom mould which has a mantle placed on a base plate. Such a mould bottom is usable again and again—after sufficient hardening of the concrete, it is removed from the mantle, is cleaned and can then be available for reuse. A disadvantage is the very complicated manufacture of such a mould bottom; for the production of uniquely shaped shaft bottoms, the same number of costly mould bottoms would have to be provided, i.e. a separate mould bottom would have to be provided for almost every shaft bottom. Since this is far too expensive, the device known from this document is used only for a small number of shaft bottoms, for instance, if a chute crosses the shaft bottom in a straight line or bent by 90° for example.

For shaft bottoms the chutes of which are to be connected to two canals running in different directions or which exhibit other special features, for cost reasons, shaft bottoms with a level bottom have been produced and the chute is manufactured on the level bottom by introducing concrete manually and forming the chute by hand. This kind of manual labour is tedious, since it is necessary to bend forward into the shaft bottom over the side wall thereof. Furthermore, the chute has to be formed with great accuracy so that both the gradient and the position of the secondary arms of the canal correspond to the local conditions of the canal system or of the pipeline system, respectively. This manual production of a chute requires qualified personnel and, for that reason, is expensive. Moreover, it also involves a substantial expenditure of time, and furthermore the quality of the manually formed concrete is not comparable with the quality of a shaft bottom that has been produced mechanically.

From DE 43 42 518 A1, it is known to form the chute by inserting a clay shell element which remains in the shaft bottom after the completion thereof, forming the bottom of the chute. Also in this case it is difficult to produce chutes to be designed individually, particularly since a separate clay shell element would have to be prefabricated for each chute, which likewise involves high expenses.

According to a further process for the manufacture of a shaft bottom, prefabricated moulded plastic parts are used with a negative mould corresponding to the chute, whereby a separate moulded part has to be manufactured for each individual chute, which moulded part is to be fixed to the mould bottom. Said moulded parts are produced as plastic shells for each individual chute according to the respective course of the chute, involving relatively high expenses, and remain as so-called dead moulds in the finished chute. A disadvantage of this process, besides the high costs for the moulded parts designed as high-quality plastic shells, is the manufacture necessarily taking place at external suppliers, whereby the entire logistics for the mechanical production of lower shaft parts becomes rather more complicated.

From U.S. Pat. No. 4,177,229, a process of the initially described kind is known. The moulded pieces used in this process are parts to be reused, which, accordingly, have a stable design and involve a special kind of fastening to the bottom mould.

The invention aims at avoiding these disadvantages and difficulties and has as its object to provide a process of the initially described kind as well as a device for carrying out the process which allow the formation of shaft bottoms with uniquely shaped chutes in a simple manner and without involving large expenditures of time and money. Furthermore, the chute should be manufacturable from high-quality concrete, i.e. a concrete that is equivalent to the mantle and the bottom, respectively, of the shaft bottom.

In a process of the initially described kind, said object is achieved in that the moulded piece is formed from a material forming a dead core so that it is not necessary to exercise special care when removing the moulded piece. Furthermore, the whole moulded piece is not suitable for other shaft bottoms because of its unique shape, however, a part of the moulded piece possibly might be.

A particular advantage of the invention is that the manufacturer of the shaft bottom himself can produce the moulded body according to the requirements of the chute to be produced by forming, in a simple manner, the moulded body from prefabricated moulded pieces available to him, the cross-sections of which correspond to the cross-section of the chute to be produced.

Preferably, the moulded body is formed from two or several moulded pieces, advantageously with moulded pieces being kept in stock, namely differently shaped moulded pieces such as moulded pieces having a linear or an arcuate longitudinal extension.

In order to produce a negative mould in the shape of a moulded body, which negative mould corresponds to the desired chute, a moulded piece or several moulded pieces is/are cut—as required—into suitable lengths and assembled into a moulded body, whereby moulded bodies in any shape can be produced by a combination of linear and arcuate mould segments. The moulded body is fastened to the bottom mould, for instance, squeezed between opposite sides of the mantle or directly fastened to the mould bottom (glued and/or screwed), whereby it is possible to interconnect the individual moulded pieces, e.g. by glueing, or to fasten them individually to the mould bottom.

The invention takes advantage of the fact that the sewage pipes to be connected to a shaft bottom have standardized diameters on which the cross-section of the chutes depends so that, even with complex chute shapes, it is possible to get by with a small number of moulded pieces having different cross-sections in order to be able to manufacture from these moulded pieces a negative mould of the chute. For this purpose, it is only necessary to prefabricate moulded pieces having an appropriate cross-section with a straight longitudinal axis and/or with a longitudinal axis shaped in the manner of a circular arc, since, if the arc radius is appropriately chosen, the mould lugs can always be assembled from individual cut-to-length moulded pieces of the straight and/or circular-arc-shaped moulded pieces in such a way that the canal and sewage pipes, respectively, whose position is predetermined, are merged fluidically in the proper way via the chutes produced with the aid of such a moulded body.

According to a preferred embodiment, the moulded piece or the moulded pieces, respectively, is/are produced from a foamed material such as EPS, whereby suitably the moulded body with the predetermined negative mould of the chute is formed from the moulded pieces formed from a foamed material by cutting and subsequent assembling and optionally joining, for instance by glueing, wherein cutting is preferably effected by means of a resistance wire.

A simple adaptation of the moulded body to the mould bottom, in particular in case of rather complex chutes, is characterized in that the moulded body formed from one moulded piece or several moulded pieces initially has a size which exceeds the floor area of the mould bottom and, after being mounted to the mould bottom, is adjusted to the circumference of the mould bottom, with the mould bottom preferably being separated from the mantle during this procedure.

Since the gradient of the chute also depends on the local conditions prevailing on a construction site, not only the course of the chute but also the gradient of the chute must be predetermined by the moulded pieces.

For taking into account the gradient of the chute, it is advantageous that, in addition to a longitudinal adjustment, also a height adjustment corresponding to the depth and/or the gradient of the predetermined shape of the chute is performed on the moulded pieces. This can be achieved in an easy way in that the moulded pieces are prefabricated with a height that is correspondingly larger than the required chute depth so that the trimmed moulded pieces can be removed, for example cut off, according to the chute gradient in the area of the attachment surface facing the bearing surface of the mould bottom. The inclination of the tread surface (berm) of the shaft bottom, which inclination is predetermined by the mould bottom, is taken into account via an additional processing of the attachment surface of the moulded pieces.

For taking into account canal and pipe connections, respectively, to the shaft bottom, in each case, one recess body bridging over the radial distance between the mantle and the mould bottom is suitably attached to the ends of the mould core, advantageously with the recess bodies also being formed from an easily processable material such as a foamed material and, furthermore, with the recess bodies suitably being adjusted, on the end side, to the gradient of the chute.

In order to simplify the provision of a seal at the shaft bottom for the purpose of providing pipe connections to the chutes and in order to determine an always correct fitting position of such a seal, according to a preferred variant, the recess bodies are furnished, on the outside, with a seal extending around the circumference prior to the introduction of concrete. During the introduction of the concrete, the part of the seal projecting beyond the circumference of the recess body is then anchored in the concrete, whereas the actual sealing lip, which initially was surrounded by the recess body, is exposed after the removal of the recess body.

In order to permit easy separation of a moulded body from the shaft bottom, said body is provided with a separation aid prior to the insertion of the concrete, said separation aid suitably being formed by at least one film placed around the moulded body and/or at least one band placed around the moulded body, which band is preferably provided in a recess of a moulded piece forming the moulded body, which recess corresponds to the cross-section of the band.

One variant is characterized in that the separation aid is formed by at least one resistance wire provided in the moulded body. Said resistance wire at least allows the moulded body to be broken up easily.

Preferably, the removal of the moulded body after the formwork has been stripped from the shaft bottom is accomplished in that a wedge-shaped piece is cut out of the moulded body, whereupon the remaining moulded body parts are folded up and easily lifted out of the chute, whereby the contact with the concrete is released.

In order to achieve the object forming the basis of the invention, a device for the manufacture of a shaft bottom made of concrete and comprising a chute of a predetermined shape using a bottom mould comprising a mantle and a mould bottom, on which a moulded body forming the negative mould of the chute is arranged for the formation of the chute, is characterized in that the moulded body is formed from at least one moulded piece mounted to the bottom mould, preferably to the mould bottom, and forming a core to be removed from the shaft bottom as well as a dead core, which moulded piece is adjusted to the dimensions of the predetermined shape of the chute.

For the sake of completeness, it must be mentioned that the device can be used both for shaking in and for casting the concrete.

Suitably, the moulded body is composed of two or several prefabricated moulded pieces, with the prefabricated moulded pieces having a linear and/or an arcuate longitudinal extension as well as a cross-section corresponding to the shape of the cross-section of the chute.

Furthermore, the moulded pieces are advantageously formed from a foamed material such as a light-weight rigid-foamed synthetic material or a thermoplastic foamed material such as EPS or a synthetic material.

A particularly simple consideration of the necessary gradient of the chute can be achieved in that the mould bottom exhibits a flat bottom which, however, is inclined for the formation of a berm, and in that the moulded body has a flat base which gets into direct contact with the mould bottom.

This particularly simple solution can also be obtained in that the mould bottom has an inclination precisely corresponding to the gradient of the chute. The measure of taking into account the chute inclination via the inclination of the berm permits a uniform chute depth throughout the chute length, which, in terms of the manufacture of such shaft bottoms, involves the advantage that the moulded pieces do not have to be processed with regard to their height if they are trimmed from prefabricated moulded pieces having a profile cross-section corresponding to the cross-section of the chute. Therefore, the operations for arranging the moulded pieces in a row, which are required for preparing the mould bottom, are not very complicated.

If a mould bottom is used with a tread surface inclined for the formation of the chute gradient, it is recommended to design the mould bottom, in particular the inclined part thereof, so as to be replaceable in order to be able to take into account different inclinations of the chute gradient by replacing the mould bottom.

For attaching the pipe connection ports to the chute, recess bodies bridging over the radial distance from the mould bottom to the mantle are preferably provided at the ends of the moulded body, wherein suitably said recess bodies are likewise formed from bodies forming a dead core, which preferably are furnished, on the outside, with a seal extending across the circumference, which seal projects with a bottom part radially beyond the recess body, whose sealing part (sealing lip), however, is inserted in the recess body.

In order to ensure that the pipe connection ports have a gradient, the recess bodies are adjusted according to the gradient of the chute at their ends attached to the moulded body as well as at the ends which reach the installation at the mantle.

A moulded body forming a negative mould of a chute of a shaft bottom is characterized in that the moulded body is formed from at least one moulded piece to be removed from the shaft bottom after the manufacture and from a moulded piece forming a dead core, which moulded piece has the dimensions of the predetermined shape of the chute, wherein the moulded body, for the purpose of taking into account different chutes, is preferably composed of two or several moulded pieces which have a linear and/or an arcuate longitudinal extension.

Preferably, the moulded body is composed of moulded pieces made of a light-weight foamed material such as a rigid-foamed synthetic material or a thermoplastic synthetic material such as EPS.

Preferably, the moulded body is, in each case, supplemented at its ends by a recess body forming a negative mould of a pipe connection, wherein advantageously the recess body is likewise formed from a body forming a dead core, preferably likewise from a light-weight foamed material such as a rigid-foamed synthetic material such as EPS or from a thermoplastic synthetic material.

A particularly simple method of attaching a seal to the shaft bottom for the connection of pipes to the chute can be achieved in that the recess body is furnished, on the outside, with a seal extending across the circumference of the same, which seal projects with a bottom part radially beyond the recess body, whose sealing part, however, is inserted in the recess body.

In order to adapt also the openings of the shaft bottom for the connection of pipes to the gradient of the chute, the recess bodies are advantageously adjusted at their ends according to the predetermined gradient of the chute.

Moulded pieces for the formation of the moulded body are characterized by a foamed material, in particular a rigid-foamed synthetic material or a thermoplastic foamed material, respectively, such as EPS, or a synthetic material and suitably have a linear or an arcuate longitudinal extension, with the cross-section corresponding to the cross-section of the chute and with the height of the cross-section of the moulded piece optionally being dimensioned larger than the height of the cross-section of the chute.

The prefabricated moulded pieces ensure the mechanical production of shaft bottoms comprising chutes of predetermined cross-sections without elaborate moulding. It is merely necessary to provide for a seamless transition between the individual moulded pieces. For this purpose, possible gaps between the moulded pieces or between the moulded pieces and the mould bottom, respectively, or around the recess pieces, respectively, can be covered and/or filled up by a joint filler.

Due to the thermoplastic properties of the foamed materials that are used, the profiled pieces can be trimmed arbitrarily not only on the face side but also in the area of the attachment surface facing the tread surface of the mould bottom by means of a resistance wire in a comparatively simple manner. The advance of the resistance wire can be controlled mechanically depending on the shape that is required in each case.

A preferred embodiment of a moulded piece is characterized in that the moulded piece exhibits, on its surface forming the chute, a recess for the insertion of a band provided as a separation aid.

A suitable variant is characterized in that at least one resistance wire is provided in the moulded piece for severing and/or detaching a part thereof, preferably a wedge-shaped part.

In the following, the invention is illustrated in further detail with reference to the drawing in which several embodiments are shown.

Figure 4:
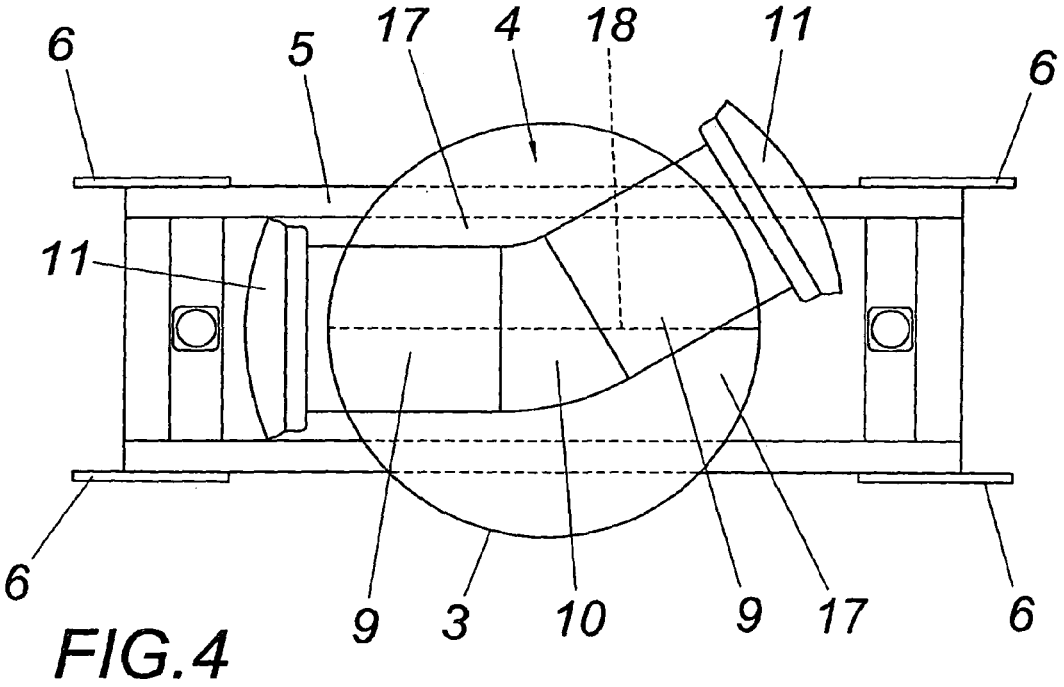
Figure 5:
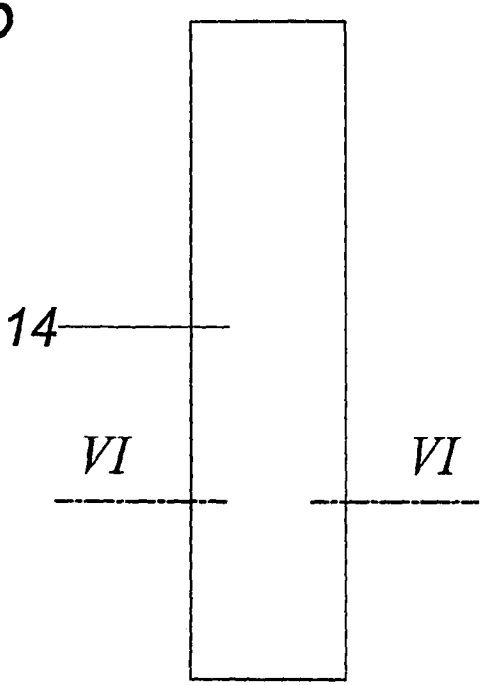
Figure 6:
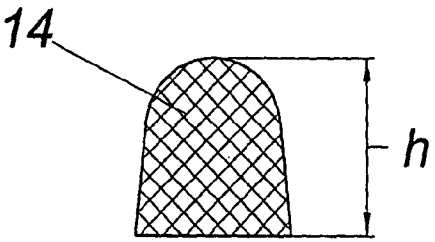
Figure 7:
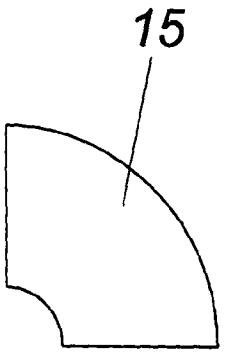
Figure 9:
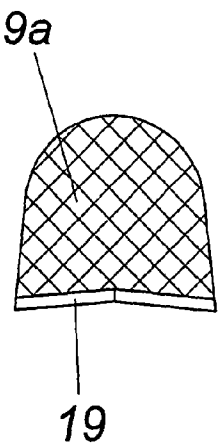
Figure 8:
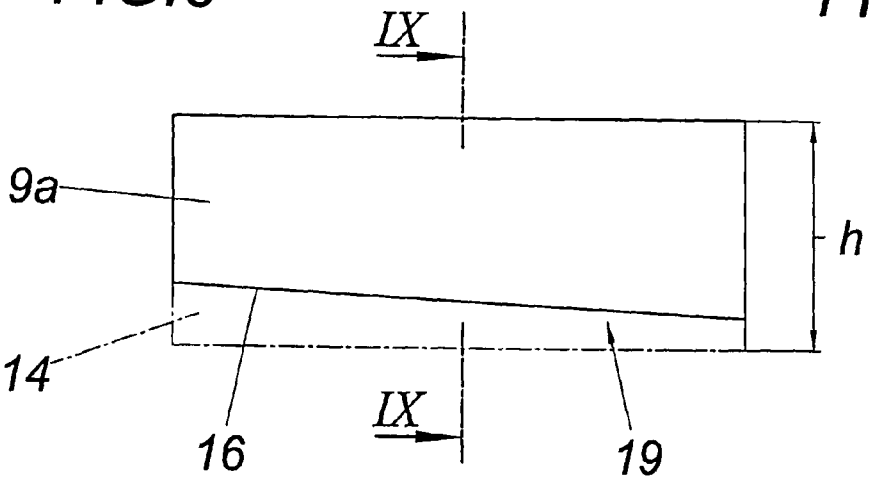
Figure 11:
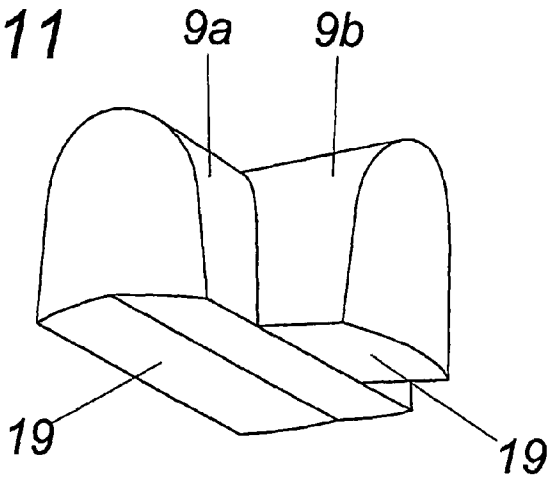
Figure 10:
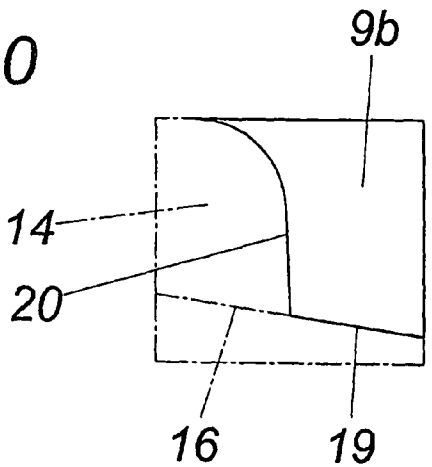
Figure 12:
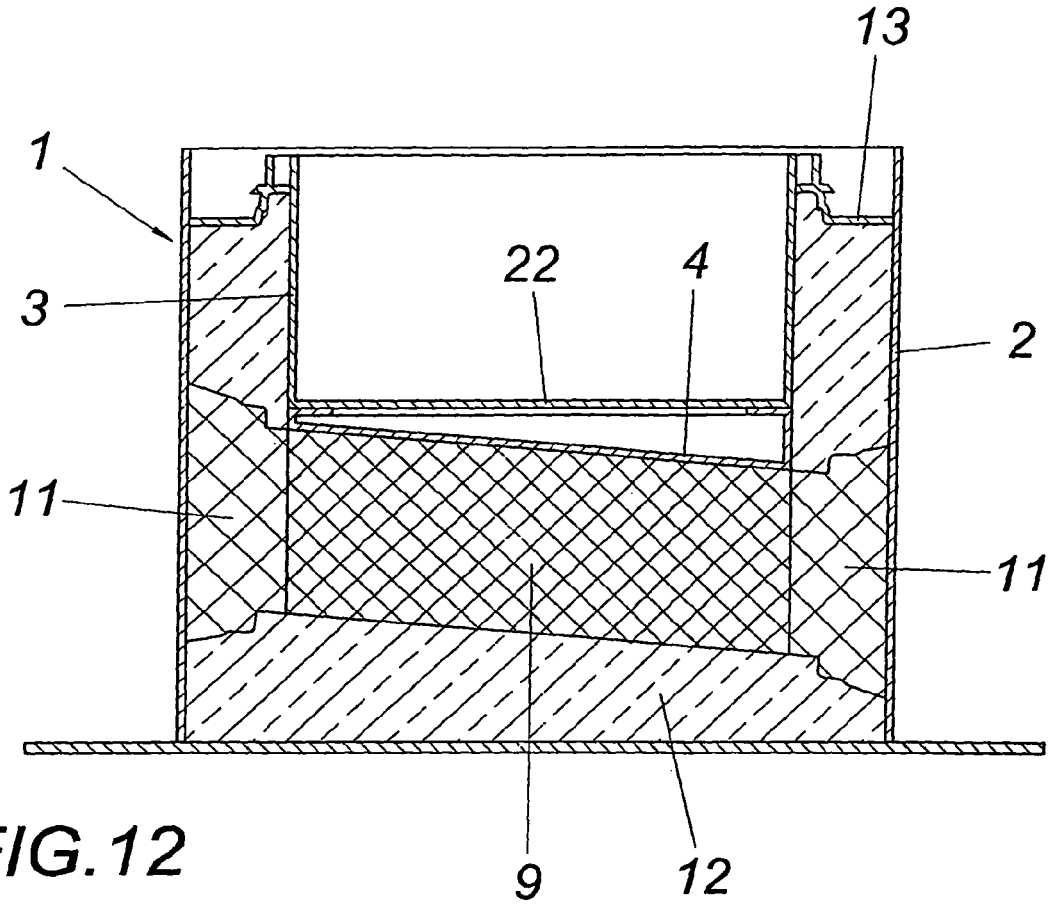
Figure 13:
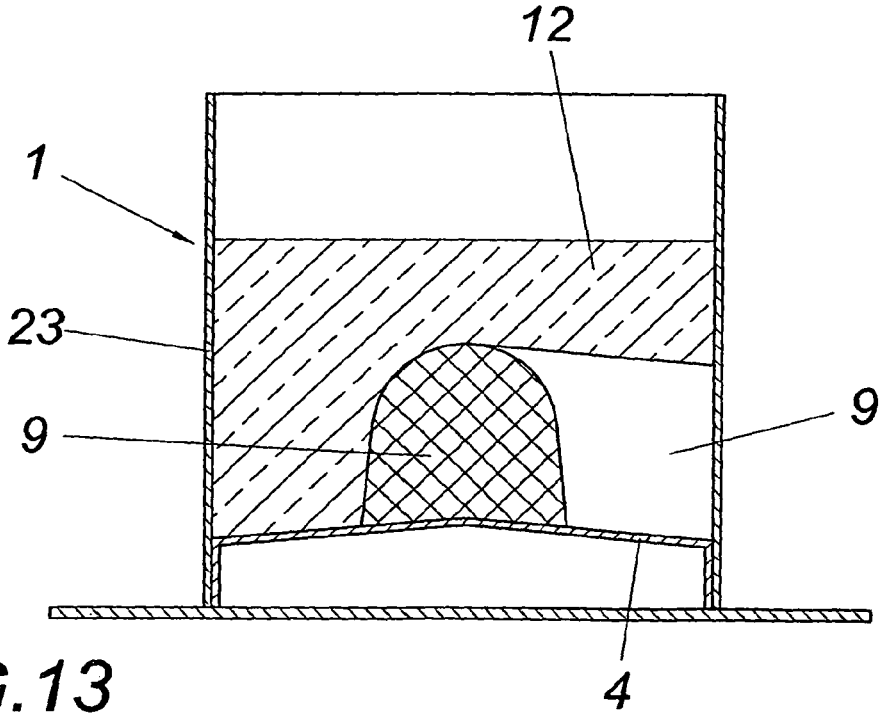
Figure 14:
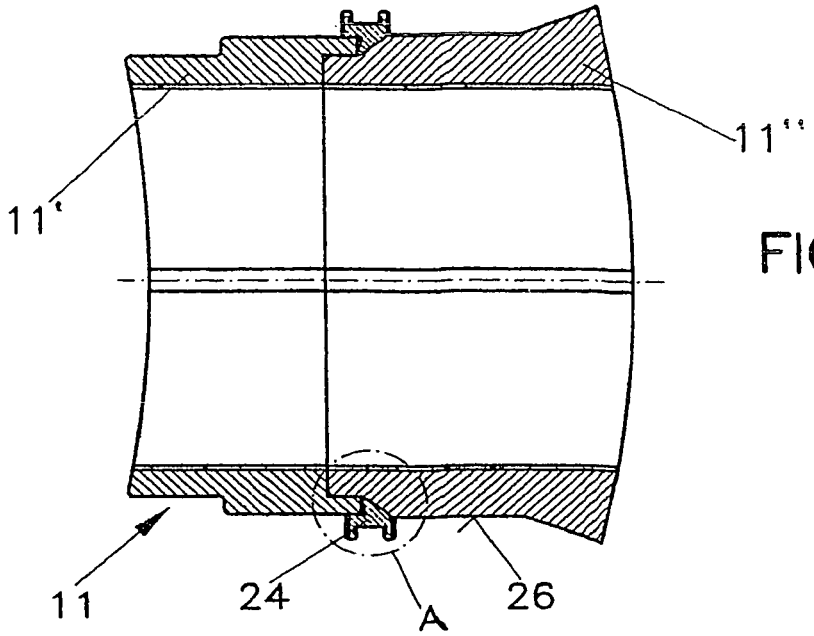
Figure 15:
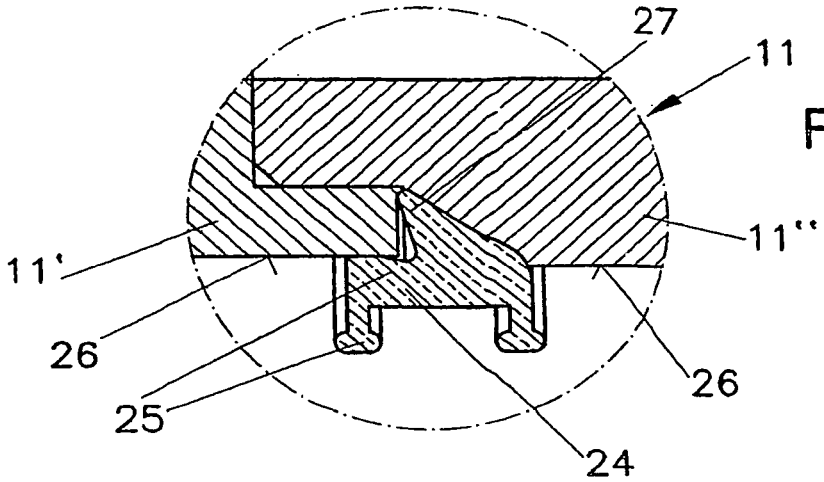
Figure 20:
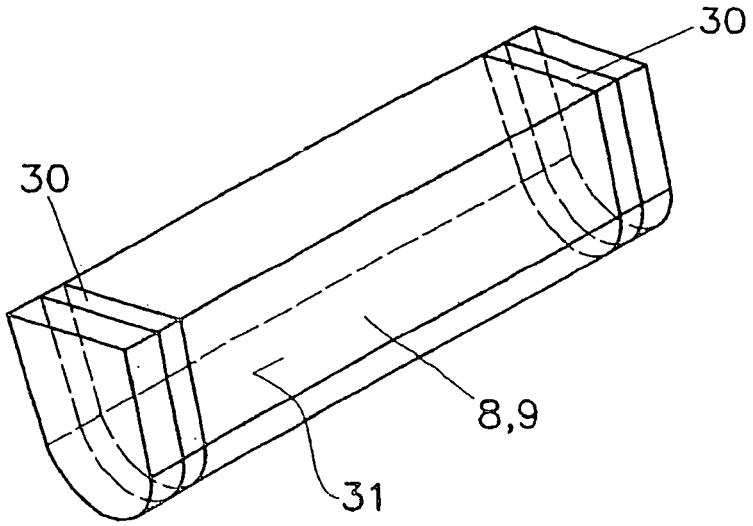
Figure 16:
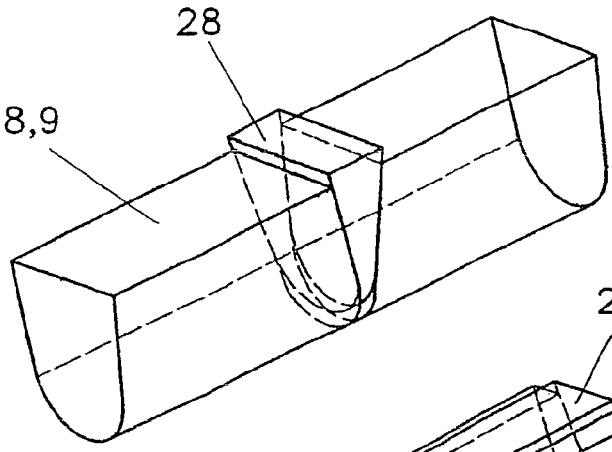
Figure 17:
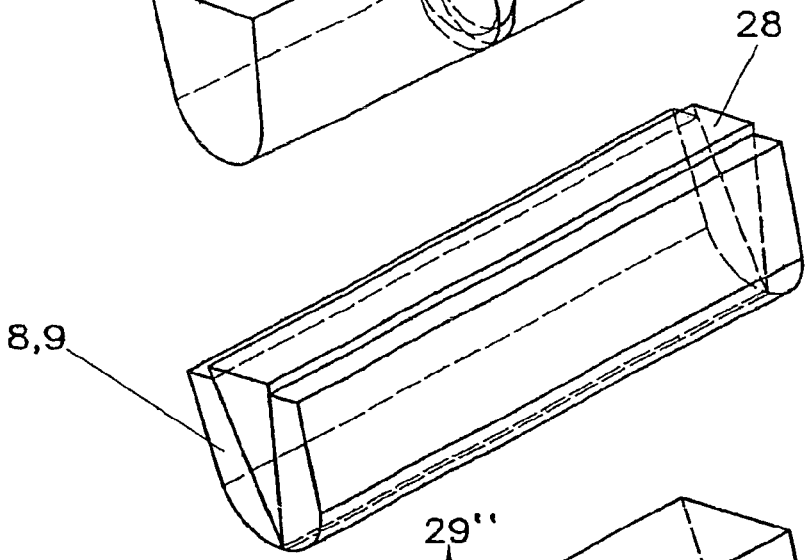
Figure 18:
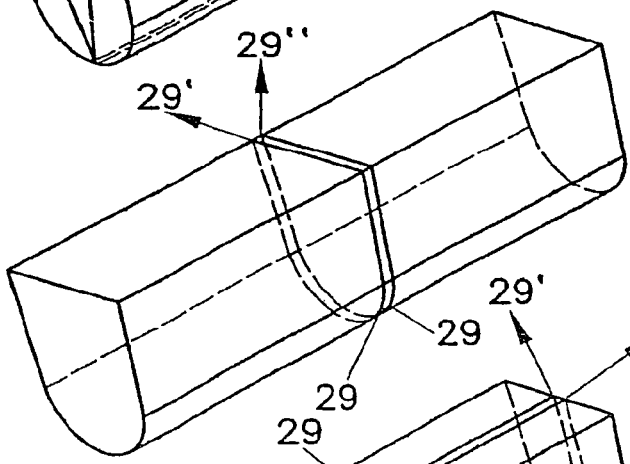
Figure 19:
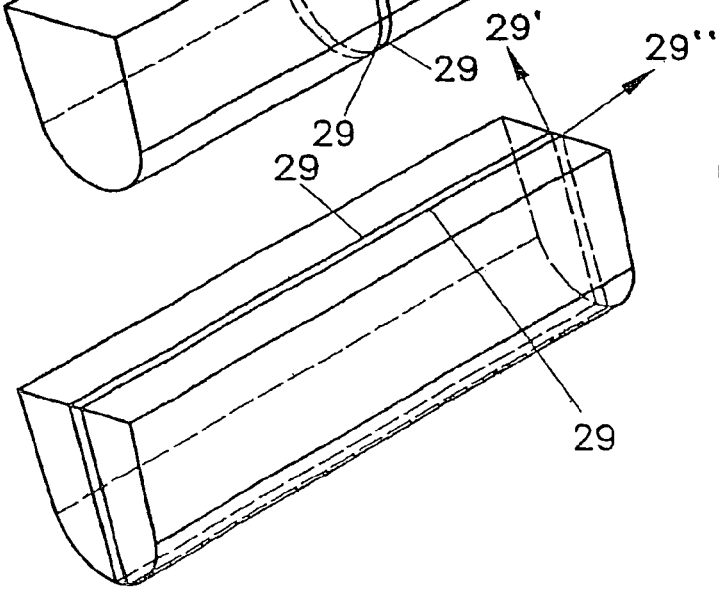

FIG. 1 shows a device according to the invention for the manufacture of a shaft bottom made of concrete in a schematic axial section, FIG. 2 shows said device in top view, FIG. 3 shows the top view of a moulded body with a moulded body modified in comparison to FIG. 1 and FIG. 2, FIG. 4 is an illustration of a further embodiment of a moulded body, which illustration corresponds to FIG. 3, FIG. 5 shows, in top view, a straight moulded piece prefabricated for the production of the moulded body, FIG. 6 shows a cross-section of the moulded piece taken along line VI-VI of FIG. 5, FIG. 7 shows, in top view, a circular-arc-shaped moulded piece having a cross-section corresponding to FIG. 6, FIG. 8 shows, in side view, a moulded piece processed from a moulded piece according to FIG. 5, FIG. 9 shows a cross-section of the moulded piece according to FIG. 8 taken along line IX-IX, FIG. 10 is an illustration of a further moulded piece, which illustration corresponds to FIG. 8, FIG. 11 shows, in diagonal view, the moulded pieces according to FIGS. 8 and 10 assembled into a moulded body, FIG. 12 shows a further embodiment of a device according to the invention for the manufacture of a shaft bottom part in a schematic axial section, and FIG. 13 shows a construction variant of a device according to the invention for the manufacture of a shaft bottom in a schematic axial section, FIG. 14 shows a recess body in section, FIG. 15 shows a detail A of FIG. 14, FIGS. 16 and 17 show a method for easy removal of a moulded piece from the chute, and FIGS. 18 to 20 show separation aids arranged on a moulded piece.

According to FIGS. 1 and 2, the device for the manufacture of a shaft bottom made of concrete has a bottom mould 1 composed of a mantle 2 and a mould bottom 3 coaxial thereto which is designed in the shape of a pot and forms a bottom 4. Said mould bottom 3 is arranged on a frame-like support rack 5 which has coupling lugs 6. The mantle 2 is provided with similar coupling brackets 7 so that the mantle 2 is not only coupled to the mould bottom 3 via the coupling lugs 6 and the coupling brackets 7 but might also be connected to a turning means in order to be able to strip the shaft bottom after manufacturing, prior to curing. However, it is, of course, also possible to cast the shaft bottom and allow it to cure accordingly, prior to stripping.

On the exterior of the bottom mould 4 of the mould bottom 3, a moulded body 8 is arranged for the formation of a chute, which moulded body is composed of straight moulded pieces 9 and circular-arc-shaped moulded pieces 10 (cf. FIG. 4) and is connected detachably to the bottom 4. Recess bodies 11 for the inflows and outflows are connected to free face sides of these moulded pieces 9 and 10, respectively, which recess bodies rest against the mantle 2 after the assembly of the mould bottom 3 with the mantle 2. The bottom mould 1 can then be placed onto a shaking table with its bottom 4 facing upward in order to shake the concrete 12 into the bottom mould 1 open at the top. As the bottom 4 and the moulded body 8 constructed thereon are covered with concrete, the chute of the shaft bottom is formed in a concrete grade that is uniform throughout the entire shaft bottom.

After smoothing the concrete, a bottom pallet 14 is placed onto the bottom mould 1 and is connected to the mantle 2 so that the bottom mould 1 is turned and the moulded shaft bottom can be deposited on the bottom pallet with the shaft bottom facing downward before the shaft bottom is demoulded. In order to demould the shaft bottom, the mantle 2 and the mould bottom 3 are detached from each other in order that the mould bottom 3 can be pulled from the shaft bottom before the mantle 2. However, the moulding ring 13 inserted between the mantle 2 and the mould bottom 3, by the aid of which an edge fold for the attachment of shaft rings on the lower shaft part is formed, remains on the face side of the peripheral wall of the shaft bottom in order to protect the fold formation in said region during the curing of the concrete 12.

Regardless of whether the concrete 12 is shaken into a bottom mould 1 turnable for stripping or is cast into a bottom mould which cannot be turned and is partly cured therein, it must be possible for a mechanical production of shaft bottoms that the moulded bodies 8 are adjusted to the respective requirements of the chute path in the shaft bottom. This is achieved with prefabricated moulded pieces 14, 15, as illustrated in FIGS. 5 to 7. With regard to their profile cross-sections, said prefabricated moulded pieces 14, 15 correspond to the required cross-section of the chute, which, in turn, must be adjusted to the nominal diameter of the adjacent sewage pipes so that it is possible to get by with comparatively few cross-sectional shapes for the prefabricated moulded pieces 14 and 15.

Since it is possible to ensure the merging of the sewers provided in their positions in the region of the shaft bottom via the chutes always with straight and circular-arc-shaped chute sections, it is sufficient, for the formation of these chutes, to provide straight moulded pieces 14 and moulded pieces 15 with a circular-arc-shaped axis, which are trimmed according to the respective requirements. According to FIG. 2, merely one straight moulded piece 14 is required for the manufacture of a T-shaped chute, whereby the moulded piece 9*b* which is vertical to the moulded piece 9*a* running diametrically across the bottom 4 has to be adjusted on the face side by trimming the face side according to the cross-sectional shape of the continuous moulded piece 9*a*, which, in case of moulded pieces 14 made of a thermoplastic foamed material, can be done easily by means of a resistance wire.

However, in addition to the course of the chute, also a chute gradient adjusted to the respective conditions prevailing on a construction site must be provided. For this purpose, the moulded pieces 14 and 15 can be prefabricated with a height h exceeding the chute depth so that the moulded pieces 14 and 15, respectively, can be removed or trimmed, respectively, in a wedge-shaped manner on the side facing the bottom 4, preferably after trimming, as evident by the interface 16 in FIG. 8 for the moulded piece 9*a* which passes through diametrically in FIG. 2. Since the berm of a shaft bottom exhibits an inclination sloping toward the chute, the bottom 4 is provided, e.g., with roof surfaces 17 sloping to both sides from a diameter, with the intersection line 18 of the two roof surfaces 17, which runs along a diameter, being oriented toward the chute outflow. This means that the attachment surface 19, whose course is preset by the interface 16, has to be trimmed additionally in accordance with the inclination of the roof surfaces 17, which, however, does not present any difficulties due to the flat roof surfaces 17. The moulded piece 9*a* processed with regard to its attachment surface 19 is illustrated in section in FIG. 9.

The moulded piece 9*b* which is vertical to the moulded piece 9*a* likewise has to be processed with regard to the gradient required for said chute section. As a result of its arrangement on merely one of the two roof surfaces 17, the inclination of the berm can, at the same time, be taken into account via the inclination of the interface 16, as can be seen in FIG. 10. In this case, the interface 16 already forms the attachment surface 19. As already illustrated, the face side of the moulded piece 9*b* facing the moulded piece 9*a* has to be trimmed according to the cross-sectional shape of the profiled piece 9*a*. In FIG. 10, the respective sectional plane is indicated by 20.

The moulded pieces 9*a* and 9*b* can now be assembled according to the diagram of FIG. 11 and can be trimmed on the free face sides according to the cylinder casing of the pot-shaped mould bottom 3 in order to subsequently be placed onto and connected to the same. The fastening of the processed moulded pieces 9*a* and 9*b* to the bottom 4 can be accomplished in various ways, since it is only important to fasten the moulded pieces 9 and 10 to the bottom 4 in a manner avoiding displacement. For this purpose, the moulded pieces 9*a* and 9*b* can be fastened to the bottom 4 with screws extending through the same.

According to FIG. 3, which shows the mould bottom 3 without mantle 2, a chute is to be manufactured with a radially continuous section and two sections running into the same under an acute angle. Again, only straight moulded pieces 14 are necessary for this purpose, which have to be trimmed and cut accordingly. As can be seen in FIG. 3, in doing so, it is by no means necessary to preset uniform cross-sectional dimensions for the chute parts. In order to avoid gaps between the individual moulded pieces 9 and in order to permit roundings in the region of the intersections between the individual moulded pieces 9, the gaps or intersections, respectively, can be filled up by a joint filler and/or covered accordingly, as indicated in FIG. 3 by reference numeral 21 in the transition region between the moulded pieces 9.

FIG. 4 shows a moulded body 8 for a chute course involving an arc. For this purpose, a circular-arc-shaped moulded piece 15 is required in addition to the straight moulded pieces 14, which circular-arc-shaped moulded piece is trimmed, according to the required length, to the moulded piece 10 between the two straight moulded pieces 9. As these moulded pieces 9 and 10 are arranged in a row on the face side, only one axially normal thrust is to be provided, creating easy manufacturing conditions.

In FIG. 12, a bottom mould 1 for casting a shaft bottom is schematically illustrated. Said bottom mould 1, in turn, has a mould bottom 3 enclosed by a mantle 2, which mould bottom is designed in the shape of a pot and carries, on its bottom 22, a replaceable bottom 4 which has a continuous inclination adjusted to the inclination of the chute gradient. Since thus the chute gradient is taken into account already via the inclination of the bottom 4, the moulded pieces 9 do not have to be trimmed in terms of their height in order to form the chute parts. According to this, moulded pieces having a profile cross-section precisely corresponding to the chute cross-section can be prefabricated, whereby the moulded pieces 9 only have to be trimmed accordingly. After attaching the recess bodies 11 for the inflow and the outflow, the moulded body provided with the bottom 4 thus prepared can be inserted in the mantle 2 and the bottom mould 1 can be filled with concrete 12. For forming an edge fold, a moulding ring 13 is placed on the concrete 12 which as been poured in. After at least partial curing of the concrete, the finished bottom shaft part can be demoulded.

As can be seen in FIG. 13, the shaft bottom can be manufactured with a flat bottom also separately from the shaft designed in the shape of a pot and can subsequently be inserted in the pot-shaped shaft. For this purpose, a bottom mould is required which exhibits an appropriate bottom 4 within a mantle 23. Moulded pieces 9, which have been trimmed in the already described manner, are assembled on the bottom 4 into the negative mould required for the chute in order to be able to subsequently cast the conrete 12 onto the bottom mould 4. After at least partial curing of the moulded shaft bottom, said bottom can be demoulded.

According to FIGS. 14 and 15, a seal 24 is provided on a recess body 11, which seal projects with its bottom part 25 beyond the surface 26 of the recess body 11 and is anchored with said bottom part 25 in the concrete as the concrete is filled into the bottom mould 1. The seal 24 projects with a sealing lip 27 into the recess body 11, which sealing lip 27 projects into the opening formed by the recess body after the formation of the shaft bottom and the removal of the recess body 11. In this way, it is possible to prevent an unintentionally inverted insertion of the seal 24 in the concrete, furthermore, the seal 24 is securely anchored in the concrete so that a displacement of the seal or an inadmissable deformation of the seal 24, respectively, can no longer occur when inserting a pipe end into the opening of the shaft bottom.

In order to easily provide a seal 24 in the recess body 11, said body has a two-piece design, composed, for example, of two pipe pieces 11' and 11". The recess body 11 as illustrated in FIG. 14 is suitably produced from the same material as the moulded body 8. It can be fastened with screws or also glued to the face sides of the moulded body 8.

In order to achieve easy detachment of the moulded body 8 or of a moulded piece 9 from the concrete during the stripping of the formwork, suitably, a wedge-shaped part 28 is cut longitudinally and/or transversely from the moulded body 8 or the moulded piece 9, respectively, using a cutting means, as illustrated in FIGS. 16 and 17. Thereupon, the moulded body 8 or the moulded piece 9, respectively, can be folded up and removed easily from the chute. Thereby, resistance wires 29 which are provided in the moulded body 8 already before the same is mounted in the bottom mould 1 can serve as cutting means, which resistance wires are connected to a power source during the stripping of the formwork and then allow a wedge-shaped part to be cut out easily (cf. FIGS. 18 and 19)—by moving it out in different directions 29' and 29", respectively.

Another variant which facilitates the removal of the moulded body 8 or of the moulded piece 9, respectively, from the chute during the stripping of the formwork is illustrated in FIG. 20. In this case, a band 30 is provided as a separation aid, for example a tear-resistant adhesive tape which surrounds the moulded body 8 or the moulded piece 9, respectively, in at least one place of its longitudinal extension. Said band 30 then allows the moulded body 8 or the moulded piece 9, respectively, to be grasped and pulled out of the chute with ease.

If this band 30 has a comparatively large thickness, the band 30 is suitably inserted in a cavity provided on the moulded body 8 from the outset and extending around the cicumference of the moulded body 8, wherein the depth of said cavity is dimensioned such that, with the band 30 being applied, a completely smooth surface 31 of the moulded body is provided.

The invention is of course not restricted to the illustrated exemplary embodiments which serve merely for the clarification of the inventive concept which consists in that various chute courses can be realized by appropriately assembling the pieces detached from the moulded pieces 9 by providing prefabricated moulded pieces 9 having profile cross-sections adjusted to the respective chute cross-section, without having to dispense with mechanical production.

A light-weight foamed material, in particular the rigid-foamed synthetic material known under the trademark "Styropor", has proven to be a particularly suitable material for the moulded body 8 and for the individual moulded pieces 9 thereof, respectively, which material can easily be foamed in female dies into the moulded pieces 9, exhibits a sufficiently high compression strength and dimensional stability after foaming, can easily be cut by appropriate cutting-off tools such as a resistance wire, saws, knives, and finally also represents a very inexpensive product.

Although moulded pieces 9 made of polystyrene can also be produced in a concrete factory by foaming in different moulds, it is normally convenient to prefabricate moulded pieces 9 in different dimensions, cross-sections and radii of curvature, which optionally provides cost advantages and guarantees consistent properties and quality, respectively. The samples suitable for the individual chute to be manufactured are then selected from various moulded pieces 9 and are cut to preset final sizes. Resistance wire cutting means with an adjustable linear and arcuate cutting guide are particularly suitable for this purpose. The mould segments cut to final sizes are then interconnected, e.g., glued together, to form the respective moulded body. The one-piece moulded body 8 thus formed is positioned in a predetermined position and fixed, for example, by detachable fastening elements after completion, e.g., with regard to its height on the mould bottom 3. However, the tailored moulded pieces 9 can also be fastened individually to the mould bottom 3 in a detachable manner and in a virtually seamless close arrangement. The material and manufacturing costs of the moulded bodies 8 produced from polystyrene are so low that single use is economically justifiable and the moulded bodies 8 can be removed from, e.g. knocked out of, the already cured chutes also if the moulded bodies 8 are damaged. Substantial cost advantages over the conventional production of individual chutes by manual brick lining are achieved by the inexpensive moulded bodies 8 and the possibility of manufacturing the shaft bottoms with individual chutes in an automated fashion.

For the manufacture of the moulded body and the moulded pieces thereof, other materials are conceivable as well which can easily be brought into the respective shape, are inexpensive, and have the compression strength necessary for the moulding of the shaft bottom. In addition, the moulded body 8 can also be manufactured from hollow moulded pieces 9, for example from pre-cut synthetic pipe parts, which, at their thrust ends, are interconnected and/or are connected to the core bottom thermally or by glueing.

The moulded body 8 should continuously have smooth outer surfaces so that also the moulded chutes receive smooth walls. If a rigid-foamed material is used, the desired smooth surfaces are already created by the foaming process. Truncated open-cell areas of such moulded pieces 9 and also of moulded bodies 8 with a relatively rough surface can be covered, for example, by the application of tailored films or liquid or paste-like substances before the concrete is cast. The covers which are made of films or other substances or are formed from separating agents such as wax or oil, respectively, can prevent adhesions of concrete and facilitate the removal of the moulded body 8.

In summary, it can be said that the invention provides a number of essential advantages over the prior art: The moulded pieces 9, 10, 14, 15 consist of inexpensive materials and can be worked with simple technical means such as knives, saws, cutting wires. The assembly of the moulded pieces 9, 10, 14, 15 into the moulded body 8 and also the fixing of the individual moulded pieces 9 or of the moulded body 8 on the mould bottom 3 is likewise accomplished in a technically simple way, e.g. by glueing or by means of suitable fastening elements such as screws, pins etc. It is essential that all those measures can be carried out by the manufacturer of the shaft bottoms on site, i.e. in the concrete factory. The simple manufacture and the low cost of a complete, optionally intricately shaped moulded body 8 permits for the first time the mechanical series production of shaft bottoms comprising individual chutes, the term "individual chute" meaning that each chute differs from other chutes in terms of, e.g., the direction of its canal. For a series production of such bottom shaft parts, repeatedly using the normal bottom moulds 1, i.e. always the same mantles and mould bottoms, it is merely necessary to detach the moulded body 8 of an already manufactured bottom shaft part from the mould bottom 3 prior to or after demoulding and to place a new prefabricated moulded body 8 onto said mould bottom 3, whereupon a further shaft bottom comprising an individual chute can be produced.

The invention claimed is:

1. A process for manufacturing a shaft bottom part made of concrete and having an individual chute of a predetermined shape, wherein said process comprises the steps of:

providing a plurality of prefabricated moulded pieces (9, 14) having a linear longitudinal extension and a plurality of prefabricated moulded pieces (10, 15) having an arc-shaped longitudinal extension;

selecting two or more moulded pieces (9, 10, 14, 15) out of said plurality of prefabricated moulded pieces (9, 10, 14, 15);

cutting and trimming the selected moulded pieces (9, 10, 14, 15) to adapt the selected moulded pieces (9, 10, 14, 15) to the predetermined shape of the chute, wherein cutting the selected moulded pieces (9, 10, 14, 15) comprises cutting the selected moulded pieces (9, 10, 14, 15) to a required length according to the predetermined shape of the chute and trimming the selected moulded pieces (9, 10, 14, 15) comprises trimming the selected moulded pieces (9, 10, 14, 15) in height according to the predetermined shape of the chute and/or trimming the selected moulded pieces (9, 10, 14, 15) at the face side of the selected moulded pieces (9, 10, 14, 15) for fitting together according to the predetermined shape of the chute;

assembling the selected moulded pieces (9, 10, 14, 15) for forming a moulded body (8) according to the individual chute geometry, said moulded body (8, 18) forming the negative mould of the chute;

inserting the moulded body (8, 18) into a bottom mould (1) comprising a mould bottom (3) and a mantle (2);

filling a mixture of concrete into the bottom mould (1); and removing the moulded body (8, 18) from the shaft bottom after or simultaneously with stripping the formwork from the shaft bottom.

2. A process according to claim 1, characterized in that the moulded body (8) is formed from two or several differently shaped moulded pieces (9, 10, 14, 15) which are kept in stock.

3. A process according to claim 1, characterized in that the moulded piece or the moulded pieces (9, 10, 14, 15), respectively, is/are produced from a foamed material, a rigid-foamed synthetic material, a thermoplastic foamed material, or a synthetic material.

4. A process according to claim 1, characterized in that the moulded body (8) initially has a size which exceeds the floor area of the mould bottom (3) and, after being mounted to the mould bottom (3), is adjusted to the circumference of the mould bottom (3), with the mould bottom (3) being separated from the mantle (2) during this procedure.

5. A process according to claim 1, characterized in that a height adjustment corresponding to the depth and/or the gradient of the predetermined shape of the chute is performed on the moulded pieces (9, 10, 14, 15).

6. A process according to claim 1, characterized in that, in each case, one recess body (11) bridging over the radial distance between the mantle (2) and the mould bottom (3) is attached to the ends of the moulded body (8).

7. A process according to claim 6, characterized in that the recess bodies (11) are also formed from a foamed material.

8. A process according to claim 7, characterized in that the recess bodies (11) are adjusted, on the end side, to the gradient of the chute.

9. A process according to claim 6, characterized in that the recess bodies (11) are furnished, on the outside, with a seal (24) extending around the circumference prior to the introduction of concrete.

10. A process according to claim 1, characterized in that the moulded body (8) is provided with a separation aid (29, 30) prior to the introduction of the concrete.

11. A process according to claim 10, characterized in that the separation aid is formed by at least one film placed around the moulded body (8) and/or at least one band (30) placed around the moulded body (8), which band (30) is preferably provided in a recess of a moulded piece (9, 10, 14, 15) forming the moulded body (8).

12. A process according to claim 10, characterized in that the separation aid is formed by at least one resistance wire (29) provided in the moulded body (8).

13. A process according to claim 1, characterized in that the removal of the moulded body (8) after the formwork has been stripped from the shaft bottom is accomplished in that a wedge-shaped piece (28) is cut out of the moulded body (8), whereupon the remaining moulded body parts are folded up and easily lifted out of the chute, whereby the contact with the concrete is released.

14. A process according to claim 1, characterized in that the plurality of prefabricated moulded pieces are selected from the group consisting of prefabricated moulded pieces (9, 14) having a linear longitudinal extension and prefabricated moulded pieces (10, 15) having an arc-shaped longitudinal extension.

* * * * *